US005820519A

United States Patent [19]

Slenker

[11] Patent Number: 5,820,519

[45] Date of Patent: Oct. 13, 1998

[54] BED EXERCISE MACHINE

[76] Inventor: Stephen Slenker, 10 Crabapple La., Chelrisford, Mass. 01824

[21] Appl. No.: 696,027

[22] Filed: Aug. 9, 1996

[51] Int. Cl.[6] ..... A63B 21/00

[52] U.S. Cl. ..... 482/4; 482/51; 482/114; 482/120; 482/127; 601/24

[58] Field of Search ..... 482/1–9, 51, 66, 482/92, 114–116, 120–127; 434/247; 601/23, 24, 26–35

[56] References Cited

U.S. PATENT DOCUMENTS 4,557,480 12/1985 Dudley .
4,669,582 6/1987 Sandreid .
4,729,456 3/1988 Sugiyama .
5,005,829 4/1991 Caruso .
5,408,435 4/1995 McClure et al. .
5,486,149 1/1996 Smith et al. .

*Primary Examiner*—Glenn E. Richman
*Attorney, Agent, or Firm*—Ware Fressola Van Der Sluys & Adolphson LLP

[57] ABSTRACT

An exercise machine mounted above one end of a bed, occupied by a bedridden patient or other supine user, has one or more double-ended ropes, each rope having a handle or a stirrup on each of its ends and a central loop tractively encircling a torque drum. Each torque drum is mounted for rotation against adjustably variable braking torque, which may be canceled in one direction of angular rotation by a one-way clutch. The handles and stirrups have adjustable rope engaging features, achieving infinitely variable rope lengths. Pulleys guide the ropes for substantially horizontal pulling reciprocation by the supine user, whose position may be braced or stabilized by torso-positioning rigid arms, such as adjustable telescoping spacer tubes, extending from the exercise machine to the user.

9 Claims, 6 Drawing Sheets

BED EXERCISE MACHINE

FIELD OF THE INVENTION

This invention is a new type of exercise machine which is used by someone who is bedridden. It has many unique features and permits a person to develop and retain muscle tone of the arms and legs while lying on the back and while eliminating any forces to the back or back muscles. It is ideal for those who are recovering from back surgery. It is also ideal for elderly or bedridden patients with any infirmity which restricts a person's normal movement.

Many kinds of exercise machines which have been sold and used, were generally designed for ambulatory users standing or sitting on or beside the machines. Except for large stationary overhead beams and levers, exercise machines for bedridden patients to permit bending and flexing of the knees and elbows are virtually unknown.

PRIOR ART

The use of a rope wrapped around a rotating drum with a variable resistance mechanism is common on exercise machines for exercising the arms. The rope length is adjustable by wrapping more or fewer turns around the drum. This only allows large increments of eight or nine inches for the length of rope. The drums are not enclosed but since these machines are used for exercise in the standing position and the drum is located at a substantial distance from the user, this is not a problem. A person lying in the supine position requires a device which is enclosed, due to the proximity of the drum to the user, to prevent the drum from pulling the user's hair, and for general safety considerations. If the drum is enclosed, the rope cannot be adjusted by wrapping turns around the drum. Additionally, since the operator's position is restricted, the rope must be adjusted in small increments of about one half inch in order to provide the proper range of exercise motion required. This problem along with many others must be solved if an exercise machine is to be used in the supine position.

There are numerous types of variable resistance mechanisms which are commonly used in exercise machines. Some of these are hysteresis types which use magnets in close proximity to a piece of metal, fluid types which use the fluid's viscosity and a turbine to create resistance, and friction between a piece of metal and a soft pad of leather or cloth. The type of variable resistance device used does not change the principle or spirit of the invention.

The use of friction variable resistance mechanism is old art and has been used on many types of "nordic" exercise machines including the NORDICTRACK® brand for the arms. This device seemed to be unsuitable for such a bed exercise machine initially. Only when it was combined with the feature of adjustable rope mechanisms in small increments by means of the special handles and stirrups could the drum friction resistance device be practically applied to this form of machine.

SUMMARY OF THE INVENTION

The present invention permits bedridden patients or those with any combination of missing limbs to obtain exercise for the remaining limbs while lying in bed. A patient with two or three missing limbs can still use it.

The machine is very light in weight and installed in about one minute. The extremely small size and light weight permit the machine to be easily transportable and packed in a suitcase with other personal luggage. The device typically weighs between 5 and 8 pounds depending on materials used and accessories that are desired. It allows a patient to exercise while lying in a hospital bed without being moved or transported to a physical therapy facility. It is very safe, since it has no stored energy devices such as weights, springs or elastic members.

It permits a patient to exercise without sitting up or changing the normal supine position which one assumes while lying in a hospital bed. It is also ideal for blind people since the force adjustments can be made without visual confirmation.

Since exercise is commonly known to accelerate the healing process, it should save considerable hospital expenses by decreasing the length of stay during convalescence. In addition, people in nursing homes and convalescent homes, who are bedridden can still obtain exercise.

The machine can be used to exercise only the legs or only the arms or all limbs without putting any strain on the back; or it can exercise one leg and both arms or one arm and one leg. It provides substantially horizontal pushing or pulling movement capability in substantially horizontal directions, against adjustable resistance force. By replacing the foot stirrups with adjustable straps, a broken ankle can be bypassed and still allow exercise to the upper parts of the leg. An amputee could even use this to exercise the remaining parts of a limb. The versatility of this design allows almost limitless possibilities for maintaining physical fitness of the patient's remaining limbs.

This machine is specifically designed to allow the range of motion to be easily adjusted in very small increments such as ½ inch, by a bedridden person. All adjustments can be made while lying on the back without moving the body. All adjustments can be made by feel so that no visual feedback is needed to determine accurately the force levels, range settings, or amounts of the adjustments. This is extremely important since a person incapacitated and unable to roll over or change body positions, can make all the necessary adjustments and change the exercise level without assistance.

The range of motion by adjusting the length of the ropes with the unique adjusting devices can be less than one half inch to over 40 inches. This means that bedridden elderly persons who could only lift their arms or legs one or two inches off the bed could still get exercise. Yet by using the maximum range and variability of forces a recovering professional athlete is capable of getting essential exercise to maintain peak muscle tone between time-consuming physical therapy sessions.

The amount of energy used can be measured by the machine for the arms and the legs either individually or cumulatively, and the calories burned can be displayed continuously on an electronic display. The amount of resistance can be set without visually observing the device.

The device can also be installed on a footboard, where the feet are in contact with the machine, and the remaining arm muscles which are not used in the original position of the machine, can be exercised.

OBJECTS OF THE INVENTION

It is a principal object of the invention to provide an extremely lightweight, portable, safe and effective exercise device for bedridden patients.

A further object of the invention is to provide such an exercise device readily useful to offer exercise to from one to four limbs while the user remains supine.

An easily adjustable range of limb movements, from ½ inch to 40 inches, is achieved by the user's touch alone, with no visual observation required.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be made to the following detailed description taken in connection with the accompanying drawings, in which:

THE DRAWINGS

BEST MODE FOR CARRYING OUT THE INVENTION

More new and novel features of the invention will become apparent as the features of this invention are explained in detail by referring to the illustrations.

Figure 1:
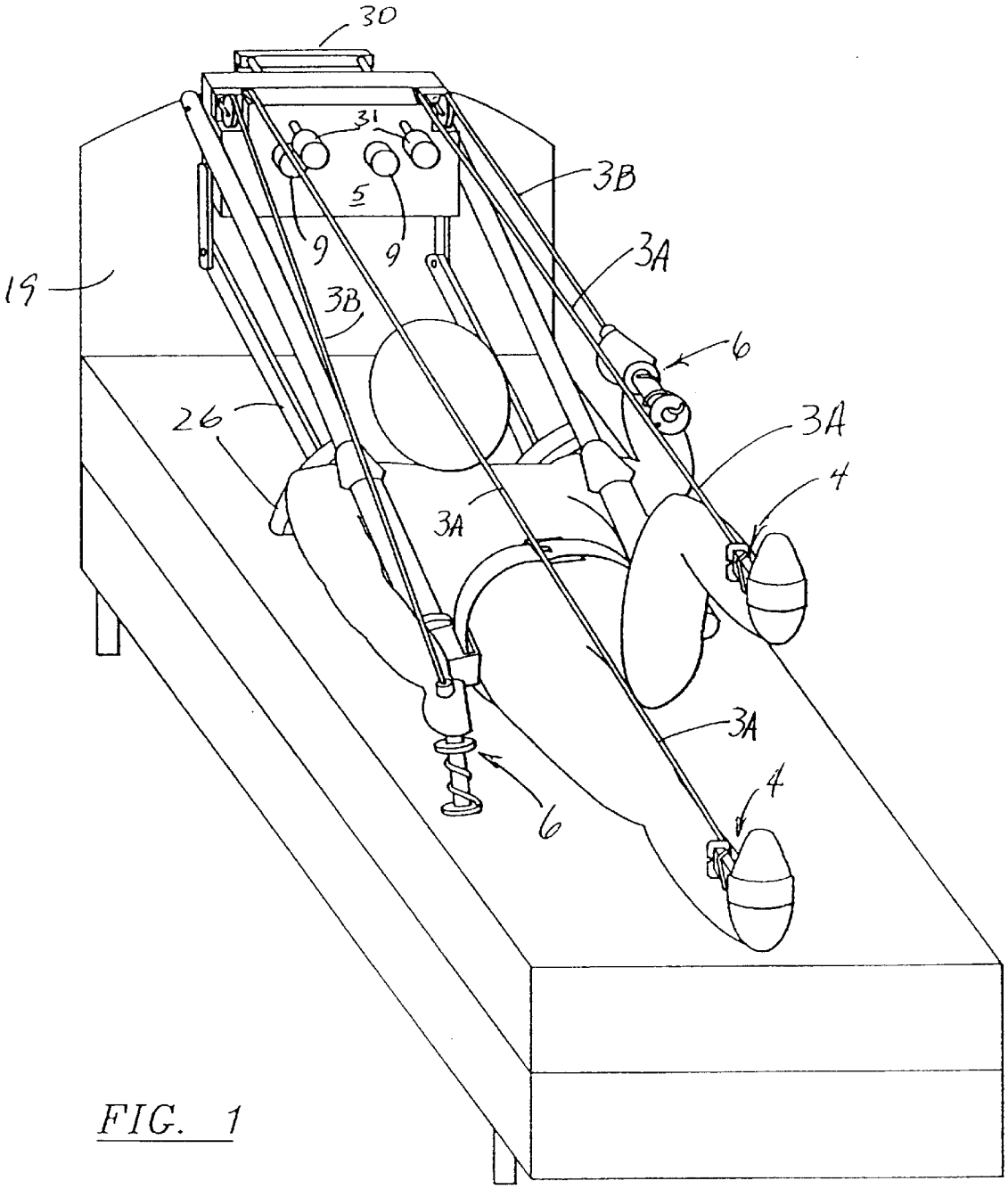
FIG. 1 is a perspective diagram showing the principal features of one embodiment of the invention during active use.
Figure 2:
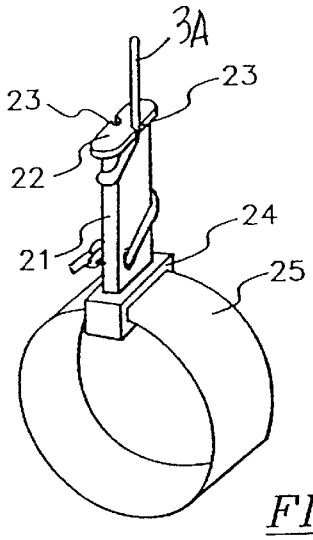
FIG. 2 is a fragmentary perspective view of an adjustable stirrup incorporated in the embodiments of FIG. 1.
Figure 7:
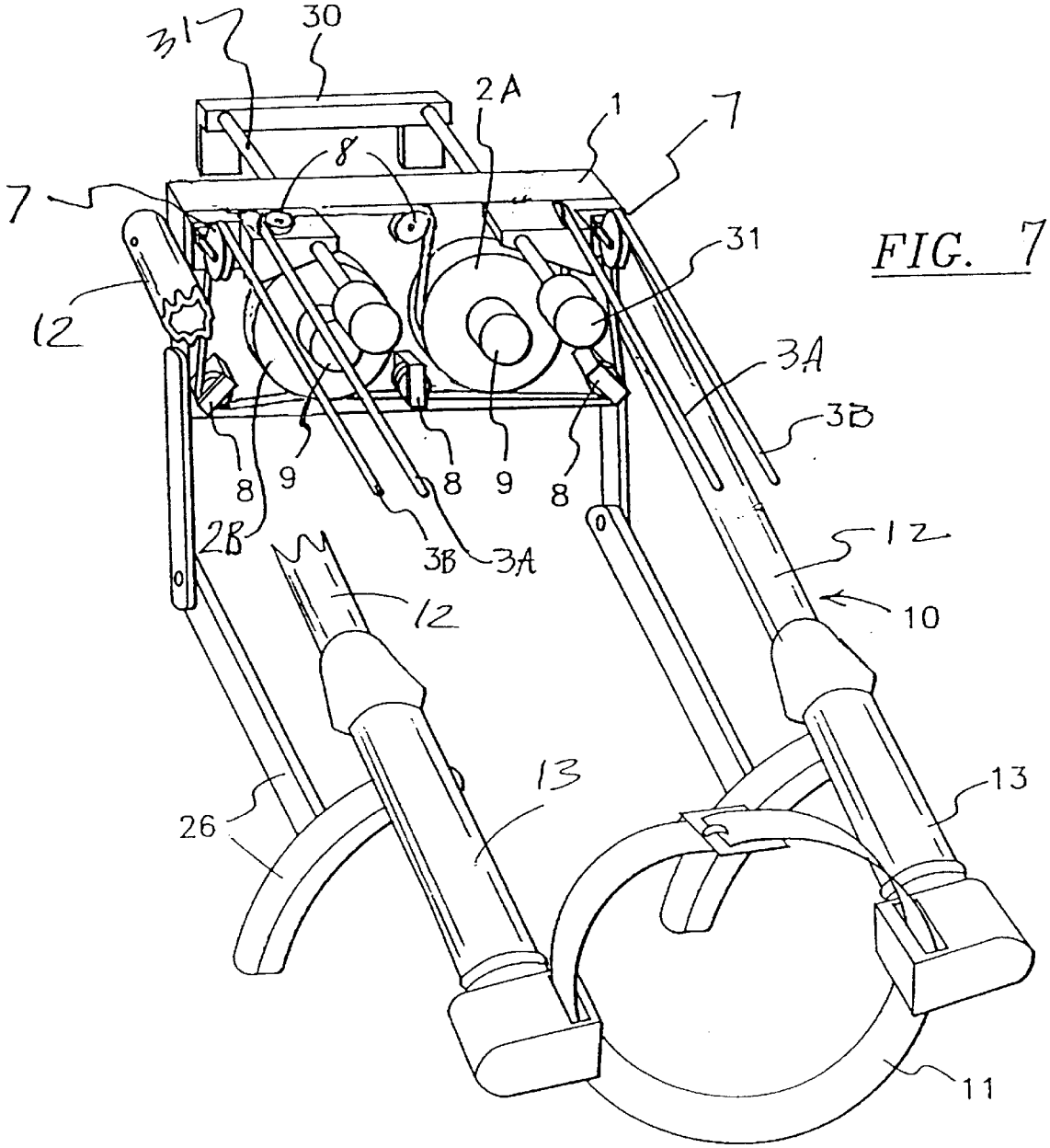
FIG. 7 is a fragmentary perspective view, partially cut away, of the embodiment of FIGS. 1–6 and 8, with its cover removed to expose the internal construction of the torque drum mechanism.

FIGS. 1 and 7 show the preferred embodiment of the invention. It consists of a mounting board 1, with two variable resistance torque drums 2, that have ropes 3 wound around them. The ends of one rope 3A have foot stirrups shown in FIGS. 2 and 10, attached to them and the ends of the other rope 3B have handles 6 shown in FIG. 3 attached to them. The ropes are directed by pulleys 7 which change the force direction at right angles to the mounting board 1. In addition the ropes are guided by pulleys 8 which prevent the ropes from contacting against each other during the normal operation of the machine and causing unnecessary wear. Housing cover 5 (FIG. 1) has been removed in FIG. 7 to show the variable resistance torque drums 2A and 2B which have variable drag forces which are adjusted by the calibrated knobs 9. As indicated in FIG. 7, the right torque drum 2A has tension rope 3A coiled around it, providing reciprocating exercise movement of stirrups 4 produced by bending and straightening of the user's knees, alternately. The left torque drum 2B has tension rope 3B coiled around it, providing reciprocating exercise movement of handles 6 produced by bending and straightening of the user's elbows, alternately.

There is a unique adjustable length waist harness 10, with a belt 11, and telescoping spacer tubes 12 and 13 with their proximal ends connected to belt 11 and distal ends pivotally connected to mounting board 1 (FIG. 7). This prevents the patient from riding up in the bed and applying unwanted pressure to his head while exercising. Harness 10 permits complete isolation of all forces on the back while exercising the legs in the supine position and is adjusted by counter rotating the tubes 12 and 13 to unlock or lock them together, and sliding them towards or away from each other. An internal cam locks the tubes together, as in a golf ball retriever or a telescoping boat hook, when they are rotated in opposite directions.

Shoulder restraints 26, suspended from board 1 and braced against the bed's headboard 19 (FIG. 1), permit complete isolation of the spinal muscles when exercising only the arms. The shoulder restraints 26 can be used in conjunction with the waist harness 11 to provide selective reduction in forces to the back muscles.

Since the sizes of patients vary, the ropes which attach to the handles 6 and stirrups 4 must be adjustable in length to accommodate the differences in the lengths of arms and legs. In addition, adjusting the rope lengths changes the length available for reciprocating motion, and permits milder or more strenuous exercise patterns to be used.

Figure 3:
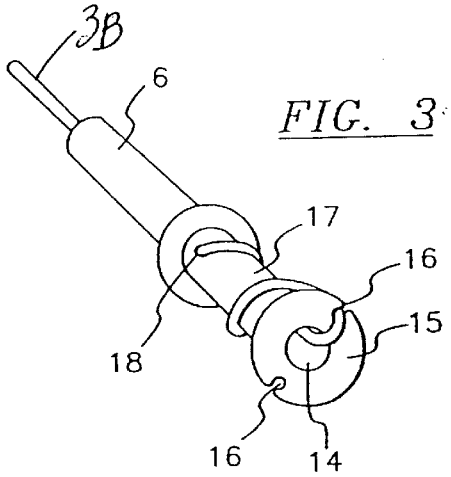
FIG. 3 is a fragmentary perspective view of a manual handle incorporated in this embodiment.

A unique adjustment mechanism is incorporated into the handles 6 (FIG. 3). The ropes pass forward through the center bore 14 of the handle 6, and are bent back over a special terminal locking ring flange 15. Ring flange 15 has two opposing notches 16, which are shaped so as to use the resiliency of the rope to snap it through a narrow throat portion of the notch into the larger circular portion of the notch, where it is retained. The excess rope is wrapped around the handle in the retaining area 17. The end of the rope is secured in the retaining area 17 by passing it through a hole 18, and tying a knot in the inside of the handle. By disengaging the rope from notch 16 and sliding the handle along the rope toward mounting board 1, the knotted rope end is freed for re-knotting at any desired new position. It is important to understand that the circumference of the handles 6 is typically about 2 inches, and the rope can be adjusted to one half this length. Since the rope is attached to both handles, an adjustment on one handle affects the length of rope of both handles. Therefore the actual increment of adjustment by adjusting only one handle is about ½ inch.

The stirrups 4 also have a unique adjusting device for adjusting the length of the rope. The stirrup assembly (FIG. 2) is composed of a molded plastic spool 21, which has a flange 22, with two shaped notches 23, and a slot 24 for the stirrup strap 25. The rope length can be adjusted by winding the rope around the body of the spool 26, and slipping the rope into one of the two notches 23, again re-knotting its end beyond spool 21.

While pulleys 7 (FIG. 7 and FIG. 10) are shown rotating in a single vertical plane, they are preferably mounted as swiveling pulleys, permitting rope ends 3B to be pulled by the user in a wide range of different directions. Handles 6 can thus be moved sidewise to extend them laterally, or downward as indicated by the user's right hand in FIG. 10, or outward away from mounting board I in a direction generally parallel to the user's spinal column, as indicated in FIG. 1 and FIG. 7.

The machine is clamped to headboard 19 by means of a clamp 30 and screws 31 (FIGS. 1 and 7). In the event a headboard 19 is not available, the machine can be clamped to the vertical member 56 of a simple L-shaped right angle bracket 47 shown in FIG. 10, with the horizontal member 58 of the bracket 57 being placed between the mattress 28 and box spring 29.

Figure 4:
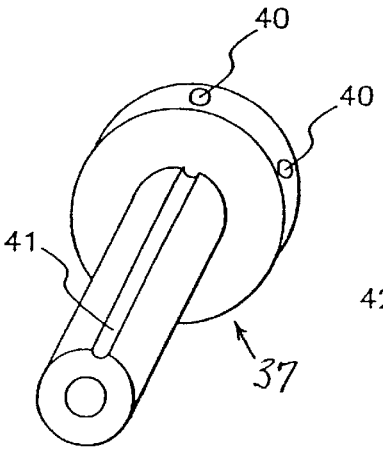
FIG. 4 is a perspective view of a central tubular nut section of a force adjustment knob in this embodiment.
Figure 5:
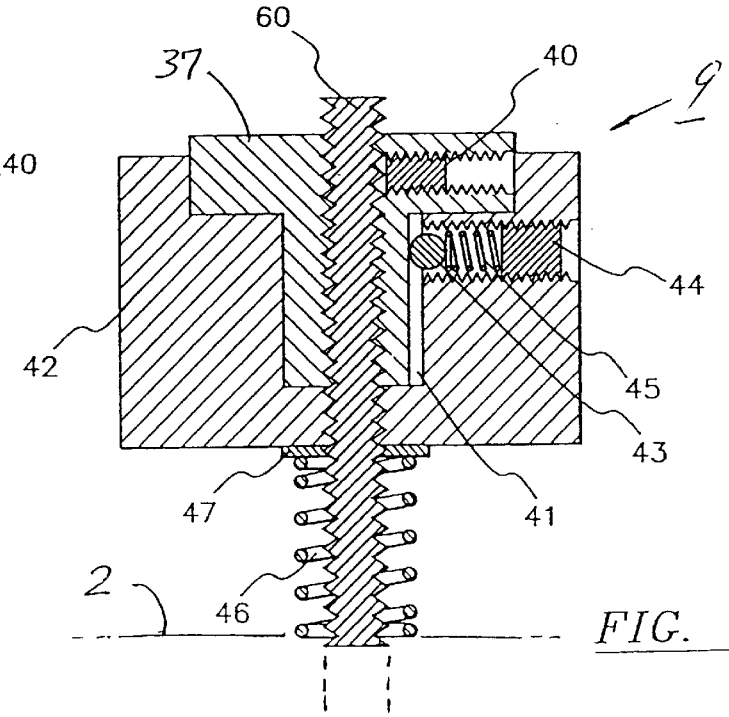
FIG. 5 is a cross-sectional axial diametric view of the force adjustment knob assembly.
Figure 8:
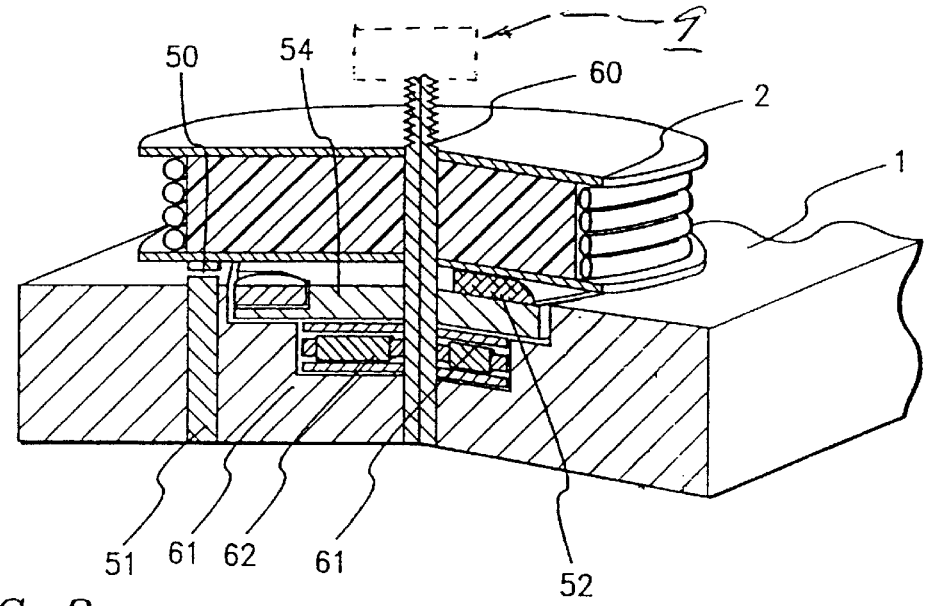

The force adjusting knobs 9 (FIGS. 1 and 5) have a unique click stop force adjustment mechanism which permits the patient to adjust the torque force resisting rotation of drums 2A or 2B without looking at the machine. This device is shown in FIG. 4 and FIG. 5. A central fixed tubular section 37 containing two set screws 40 and a rounded groove 41 is located concentrically inside an external force adjusting knob 42. Both tubular section 37 and knob 42 have an internal threaded bore, independently engaged on the protruding threaded end of threaded rod 60 (FIG. 5 and 8), whose unthreaded end is anchored in mounting board 1 and provides the shaft on which torque drum 2A or 2B is rotatably mounted (FIG. 8). A helical compression spring is engaged on rod 60 between each drum and its knob 42. A spring loaded ball 43 retained by a set screw 44 and spring 45 in knob 42 (FIG. 5) engages the groove 41 in tubular section 37 and provides positive click stops to determine the amount of force applied by the spring 46 as knob 42 is rotatably adjusted relative to rod 60 and section 37 set-screwed thereon. Rotating adjustment of knob 42 thus compresses spring 46, increasing the friction drag force applied by spring 46 to resist rotation of the drum. A roller thrust bearing 47 between spring 46 and knob 42 prevents the adjustment knob 42 from being rotated by the motion of the drum 2 being rotated.

Figure 6:
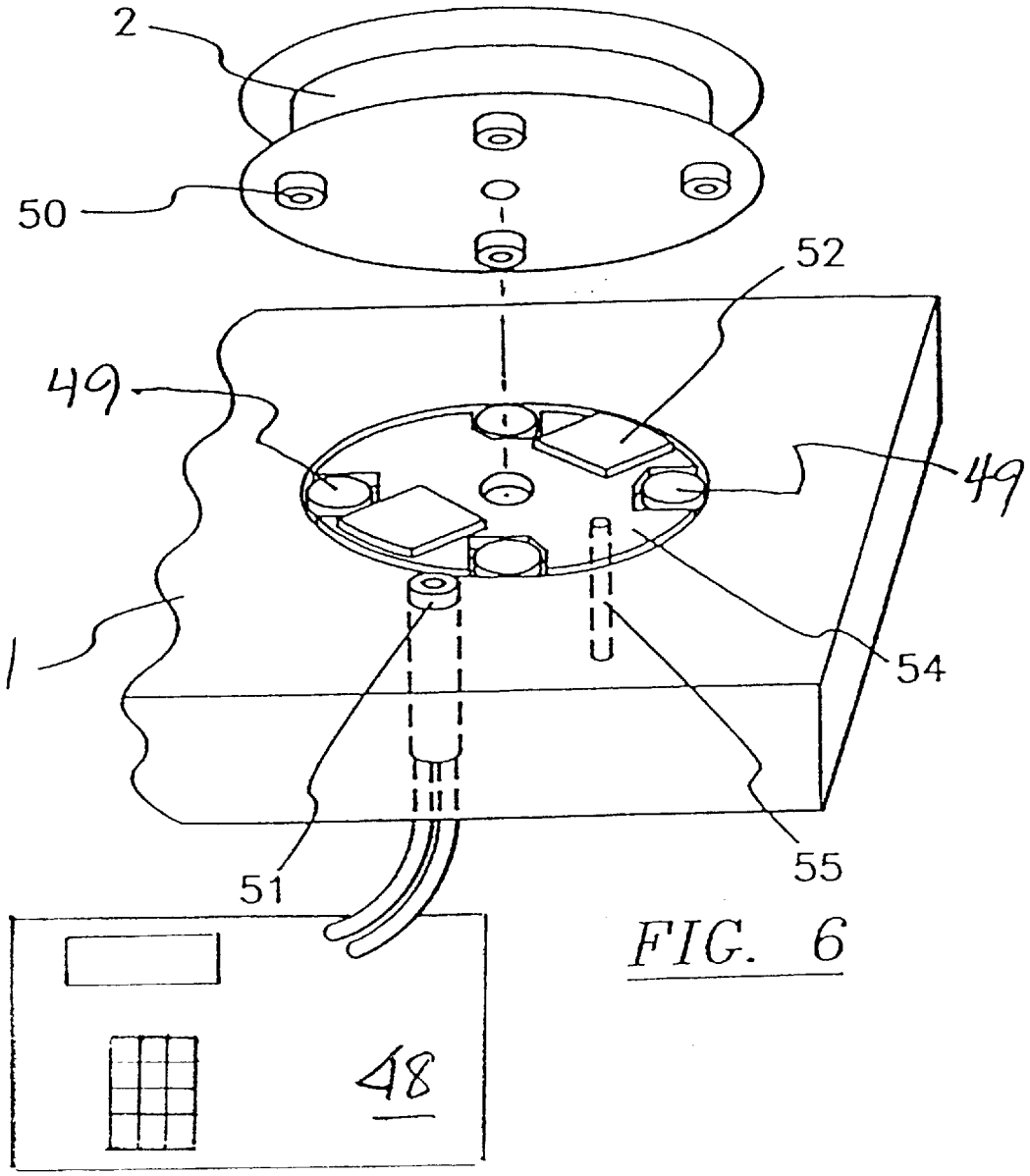
FIGS. 6 and 8 are perspective diagram views of a torque drum assembly whose resistance to rotation is adjusted by one of the force adjustment knobs.
Figure 9:
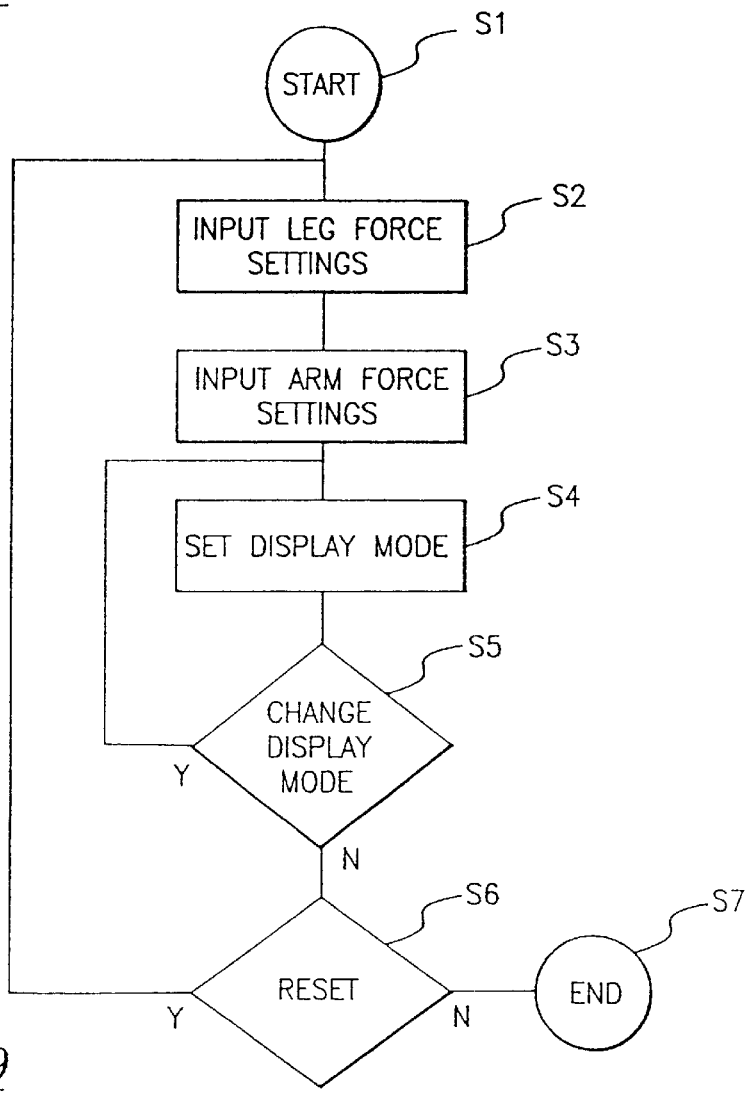
FIG. 9 is a flow diagram of the steps involved in determining and displaying the energy produced by the user exercising on the mechanism.

In addition, each of the drums 2 shown in FIG. 6 has large head ferromagnetic screws 50 protruding from the bottom of the drums. A magnetic pickup 51 in board 1 senses the proximity of each screw 50, when the drum is rotated during exercising use. The resulting signal is supplied to a tiny computer 48 which calculates energy used from the length and velocity of rotation and the resistance force set by the force adjusting knobs. A digital keypad on the computer allows the adjusted forces to be input. The computer operational flow diagram is shown in FIG. 9, and is self explanatory.

Figure 10:
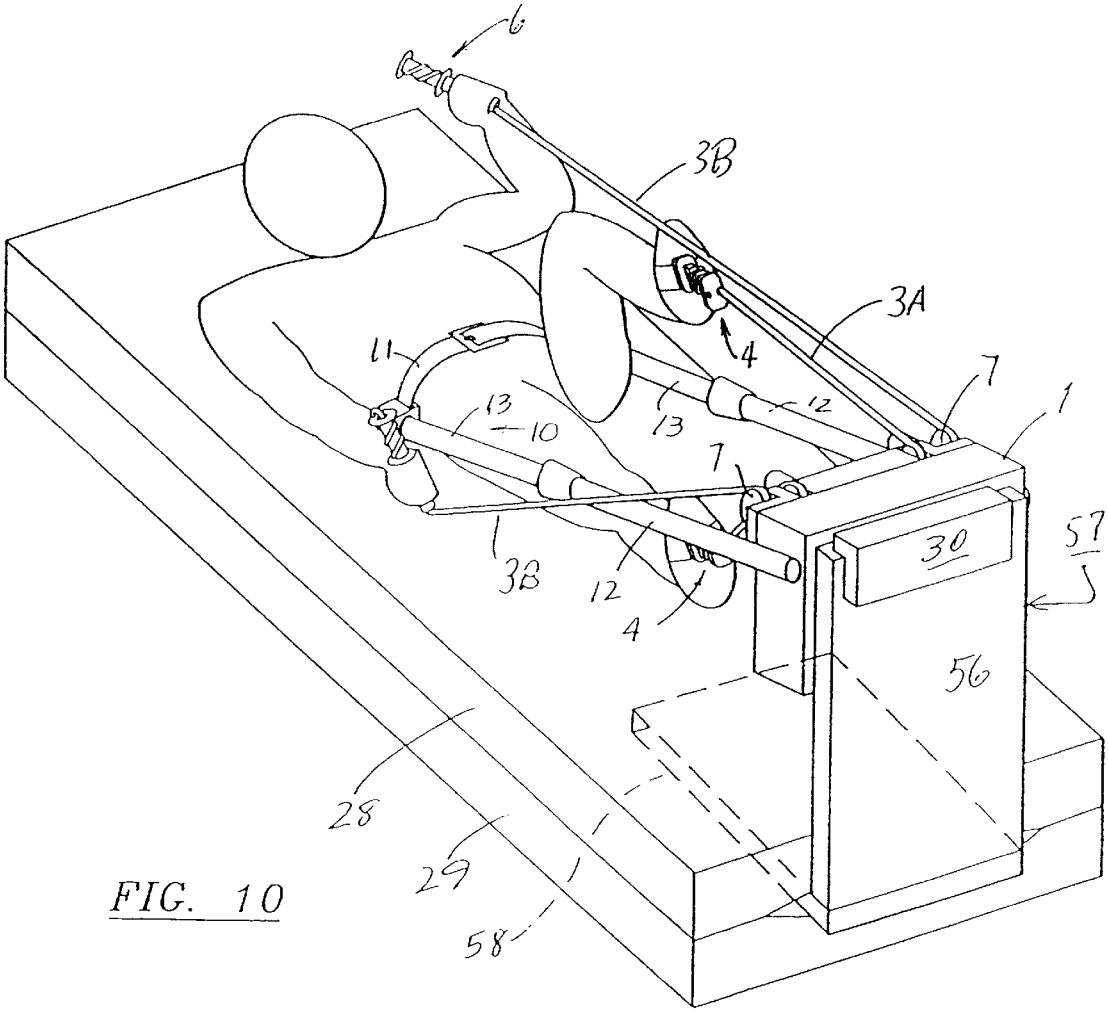
FIG. 10 is a perspective diagram comparable to FIG. 1 showing a different embodiment, with the device mounted on a removable footboard.

The resistance is generated by pressure from the force adjusting mechanism of FIG. 5 pressing the drums 2, against leather pads 52 underneath them as shown in FIG. 6 and FIG. 8. A one-way clutch mechanism is located between the upper disc assembly 54, and the mounting board 1. The one way action is obtained by the rollers 49 being wedged between the rotating leather pad assembly 54 and the stationary mounting board 1 when rotated in the clockwise direction (as viewed in FIG. 6) but being released when rotated in the opposite, counterclockwise direction. The preselected adjusted friction drag force is thus applied only during clockwise clutch engagement, freeing the torque drum for unimpeded rotation counterclockwise. The variable resistance exercise device thus offers two different resistance forces, depending on the direction in which the rope is being pulled. A locking pin 55 can be inserted to disable the clutch mechanism by locking together the rotating assembly 54 with the mounting board 1. Two leather pads 52 then provide drag force against the bottom of each drum 2 to provide the equal exercise resistance force to the ropes, adjusted by rotating knob 42, regardless of which rope is being pulled. When the locking pin 55 is removed, and a pulley is attached to a footboard as shown in FIG. 10, but with the ropes from two of the handles tied together by an extension rope and a pulley attached to the headboard (not shown), a single limb can be exercised. Another way of exercising one leg when the user has two arms is to attach one stirrup to the leg and hold the opposing stirrup with both hands, so as to pull it and cause a reciprocating motion. This allows three limbs to be exercised and requires no attachments or accessories.

Additionally, the machine can be attached to the footboard as shown in FIG. 10 to provide a pulling motion for the arms and legs, rather than a pushing motion which is obtained when the machine is attached to the headboard as shown in FIG. 1.

An assembly view of the force drum mechanism is shown in FIG. 8. The leather pads 52 provide drag force against the torque drum assembly 2, and the magnetic sensor 51 is seen located on a larger radius from the leather pads and in line with the screw heads 50. The threaded rod 60, for the adjustable spring tensioning device 9 is shown.

Also the roller thrust bearing 62 is shown, operating against flat washers 61 installed in mounting board 1.

It will thus be seen that the objects set forth above, and those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An exercise device having a mounting board anchored above one end of a user's bed, providing exercise for a bedridden user's limbs, incorporating:

at least one torque drum rotatably mounted on said exercise device mounting board, a length of rope having both ends extending substantially horizontal and presented near the user's legs, each rope end being provided with a limb-extremity engaging unit, said rope length having between said ends a central loop tractively encircling one said torque drum by at least one complete turn, for rotating said drum in response to tension force applied to each said rope end alternatively, and torso-positioning rigid arm means releasably connected between said mounting board and the user's torso, positioning the user longitudinally on the user's bed and counteracting user-displacing reaction force caused by exercising use imposing tension force on one said rope end.

2. The exercise device of claim 1, wherein the rigid arm means includes at least one adjustable telescoping spacer tube pair having two ends, one end connected to the mounting board, and the other end connected to a belt encircling the user's waist.

3. The exercise device of claim 1, wherein the rigid arm means includes two of said adjustable telescoping spacer tube pairs.

4. The exercise device of claim 1, wherein the rigid arm means includes at least one rigid shoulder restraint positioned to engage the user's shoulder and blocking movement of the user toward the head of the bed as a result of user-displacing reaction force caused by exercising use imposing tension force on one said rope end extending from the user toward the head of the bed.

5. The exercise device of claim 4, wherein the rigid arm means includes two said rigid shoulder restraints, each positioned to engage one the user's shoulders.

6. The exercise device of claim 1, further including:

manual adjustment means cooperatively joining each said torque drum with said mounting board of said device and operatively connected to change frictional drag force between said drum and said mounting board, thus adjusting the amount of tension force in said rope required to produce rotation of said drum, wherein the limb-extremity engaging unit is adjustably connected to its rope end by a wrapping stem having a first end and a second end, around which at least one turn of the rope end is wrapped, with means forming a knot-retaining aperture passing through said stem near the first end thereof, and with a notch-flange projecting laterally from said stem at the second end thereof and provided with a rope-clasping notch maintaining the rope wrapped on said stem, whereby the rope end is readily removed from the notch, unwrapped, advanced or retracted through the aperture, re-knotted at its bitter end to any adjusted length desired, re-wrapped and re-clasped in said notch for accurate adjustment of each rope end to any desired length.

7. The exercise device of claim 6 wherein a stirrup is joined to said wrapping stem at the first end thereof, for engagement with the user's foot.

8. The exercise device of claim 6 wherein a cylindrical handle is joined to said wrapping stem at the first end thereof, for gripping in the user's hand.

9. The exercise device of claim 8, wherein the handle and stem are formed as a unitary hollow tube, through which the rope end extends from said notch toward said torque drum.

* * * * *

UNITED STATES PATENT AND TRADEMARK OFFICE

CERTIFICATE OF CORRECTION

PATENT NO. : 5,820,519

DATED : Oct. 13, 1998

INVENTOR(S) : Stephen Slenker

It is certified that error appears in the above-identified patent and that said Letters Patent is hereby corrected as shown below:

In column 4, line 65, "I" should be --l--.

Signed and Sealed this

Twenty-sixth Day of January, 1999

*Attest:*

*Attesting Officer*

*Acting Commissioner of Patents and Trademarks*